United States Patent [19]

Caan

[11] 4,157,705

[45] Jun. 12, 1979

[54] RANGE GUARD

[76] Inventor: Michael N. Caan, 5911 Harwick Rd., Bethesda, Md. 20016

[21] Appl. No.: 848,730

[22] Filed: Nov. 4, 1977

[51] Int. Cl.[2] ..... F24C 15/36

[52] U.S. Cl. ..... 126/211; 126/24; 126/214 D

[58] Field of Search ..... 126/24, 211, 215, 214 D, 126/42

[56] References Cited

U.S. PATENT DOCUMENTS 3,513,826 5/1970 Hellmuth ..... 126/211

4,089,321 5/1978 Ondrasik ..... 126/215

*Primary Examiner*—Edward G. Favors

*Attorney, Agent, or Firm*—Bacon & Thomas

[57] ABSTRACT

A range guard is formed of a length of transparent resilient plastic shaped to rest on a range top and provide an upstanding wall along the front edge of the range and rearwardly extending side walls which can be resiliently flexed outwardly and have slots adapted to fit over retaining flanges on brackets secured to the range top so that the guard may be selectively mounted on the range or removed therefrom.

5 Claims, 5 Drawing Figures

RANGE GUARD

BACKGROUND OF THE INVENTION

This invention is in the field of guard devices for cooking ranges to prevent children from burning themselves by touching hot burners or by pulling hot utensils off the stove.

Many proposals have been made heretofore for attachments for cooking ranges for the purpose of preventing splashing or for preventing cooking utensils from sliding off the range and even for preventing inadvertent manipulation of the range controls. However, such devices have been bulky and unweildy or of complicated construction and generally incapable of easy removal or mounting in position of use. For example, see the following prior patents:

| | | | |
|---|---|---|---|
| 168,696 | Sweden | 3,513,826 | Hellmuth |
| 2,772,414 | Baker, Jr. | 942,382 | British |
| 2,699,162 | Nazzaro | 888,704 | British |
| 1,536,016 | Kavanagh | | |

SUMMARY OF THE INVENTION

The present invention relates to a simple strip of plastic material bent to generally U-shape to define an upstanding front wall and short side walls or wings arranged to extend rearwardly along the stove top. Simple brackets may be secured to the range top and cooperate with the rearwardly extending walls of the guard to releasably retain the same on the range whereby it may be mounted or removed by a very simple manipulation. The guard walls are sufficiently high to prevent small children from reaching utensils on the stove or from placing their hands on heated burners.

DESCRIPTION OF THE PREFERRED EMBODIMENT

Figure 1:
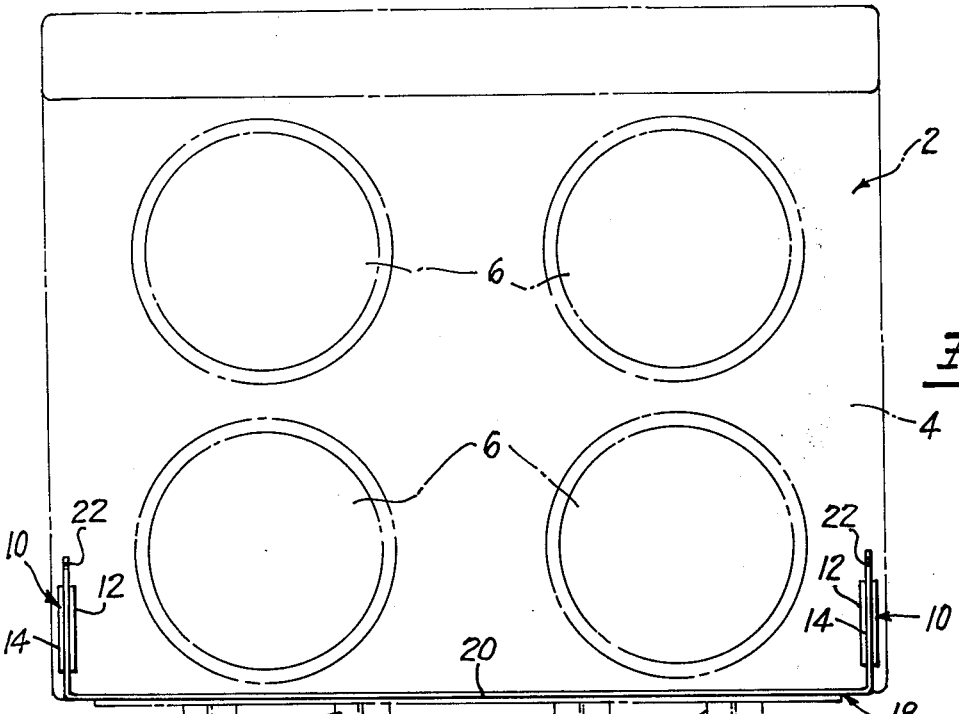
FIG. 1 is a schematic top plan view of a range having the guard of the present invention applied thereon.

In FIG. 1, numeral 2 schematically indicates any conventional cooking range having a generally flat top 4 and burners 6 thereon. The burners 6 may be gas burners or electric heaters or any other heating means provided on a cooking range; Numeral 8 indicates the usual controls for the burners.

Figure 2:
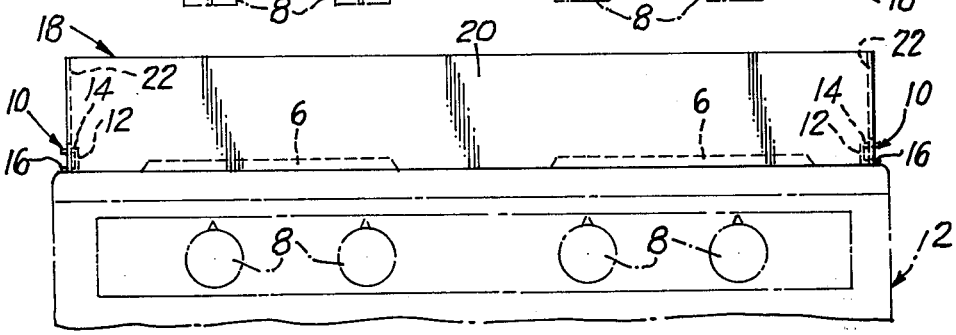
FIG. 2 is a fragmentary elevational view of the front portion of the range and guard.
Figure 4:
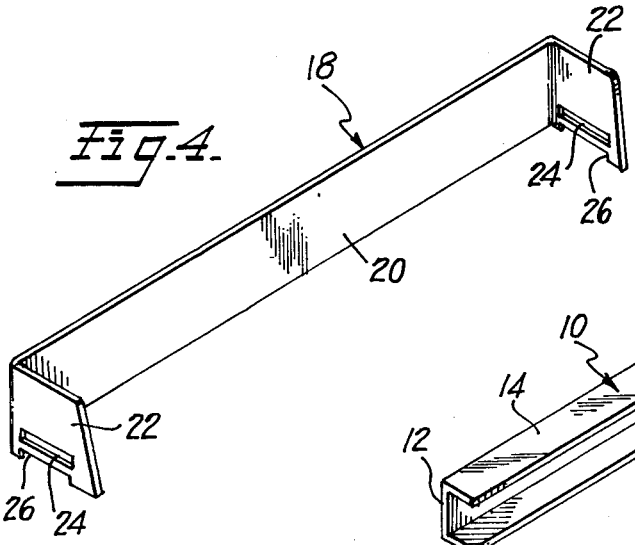
FIG. 4 is a perspective view of the guard.
Figure 3:
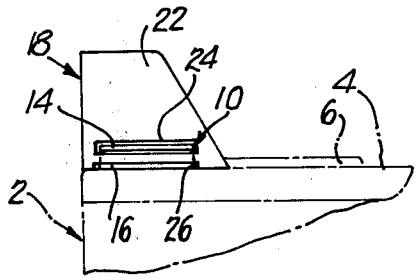
FIG. 3 is a fragmentary end view of FIG. 2, as seen from the right hand end thereof.
Figure 5:
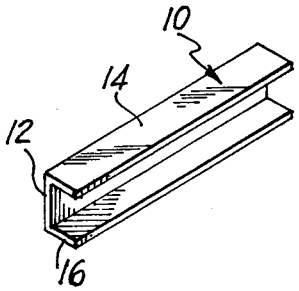
FIG. 5 is a perspective view of a retaining bracket.

Fixed to the range top are opposed brackets 10 adjacent the side edges of the top 4 in the form of short lengths of rigid channels each having a base wall 12 (see FIG. 5) and upper and lower flanges 14 and 16. Obviously, the retaining means 10 could be cut from continuous lengths of extruded aluminum, for example, very inexpensively. Each of the brackets 10 is preferably secured to the range top 4 by adhesive means (not shown) adjacent the side edges of the range top with the channel openings facing outwardly as clearly shown in FIG. 2. Any suitable adhesive may be employed to secure the channels to the range top, for example, pressure sensitive adhesives.

The range guard 18 is preferably formed of a length of any suitable plastic material, preferably but not necessarily transparent. The strip is formed to a general U-shape to provide a front wall 20 and rearwardly extending side walls 22. The side walls 22 may be in the form of relatively short wings and the side walls 22 are each provided with a horizontal slot 24 spaced above its lower edge and a notch 26 in its lower edge. The material of the guard is resiliently flexible so that the wings or side walls 22 may be flexed outwardly away from each other sufficiently to clear the outer edges of the flanges 14 of retaining means 10 whereupon the entire guard may be placed on the range top and the side walls permitted to resiliently return to their normal position with the slots 24 embracing the upper flanges 14 of the retaining means 10 and with the notches 26 straddling the lower flange 16. Thus, the guard 18 is securely retained in position on the range top and the front wall 20 is sufficiently high, for example, 3" to 6", to prevent small children from reaching hot utensils on the range and pulling the same off, which could result in serious injury to the child. At the same time the guard prevents such children from reaching up and touching hot burners on the range which would likewise result in serious injury.

In the usual or customary installation of such ranges in a kitchen, cabinets are normally placed alongside the range, thus the side walls or wings 22 need extend rearwardly only a very short distance rather than the full length of the side edges of the range.

While a single specific embodiment of the invention has been shown and described, it is to be understood that the same is merely illustrative of the principles of the invention which is limited only by the scope of the appended claims.

I claim:

1. Guard means for a range having a generally flat top and heating means thereon, comprising:

a unitary guard member having a front wall portion adapted to extend upwardly from said range top along the front edge thereof;

side walls extending rearwardly from the ends of said front wall portion and adapted to extend along the side edges of said range top, said side walls being resiliently flexible away from each other and having retainer engaging means thereon; and at least a pair of retaining members adapted to be secured to said range adjacent respective side edges thereof and being configured to interlockingly engage said retainer engaging means whereby said side walls may be flexed outwardly to releasably engage their retainer engaging means with said retaining members and releasably hold said guard on said range.

2. Guard means as defined in claim 1 wherein said guard member is of transparent plastic material.

3. Guard means for a range having a generally flat top and heating means thereon, comprising:

a guard member having a front wall portion adapted to extend upwardly from said range top along the front edge thereof;

side walls extending rearwardly from the ends of said front wall portion and adapted to extend along the side edges of said range top, said side walls being resiliently flexible away from each other and having retainer engaging means thereon; and at least a pair of retaining means adapted to be secured to said range adjacent respective side edges thereof whereby said side walls may be flexed outwardly to releasably engage their retainer engaging means with said retaining means and hold said guard on said range, each of said retaining means including a laterally extending retainer flange, said retainer engaging means comprising a slot in each side wall of a size to releasably embrace a corresponding flange.

4. A guard means as defined in claim 3 wherein said guard member is dimensioned to rest on said range top adjacent the front and side edges thereof, said retaining means each being a channel shaped member adapted to have a lower flange thereof secured to said range top, the other flange thereof comprising said retainer flange.

5. A guard means as defined in claim 4 wherein each of said side walls is notched at its lower edge, below its slot, with a notch dimensioned to embrace said lower flange.

* * * * *